US006398507B1

(12) United States Patent
Choi

(10) Patent No.: US 6,398,507 B1
(45) Date of Patent: Jun. 4, 2002

(54) OVERHEAT PROTECTION DEVICE FOR SCROLL COMPRESSOR

(75) Inventor: Se Heon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/484,176

(22) Filed: Jan. 18, 2000

(30) Foreign Application Priority Data

Oct. 4, 1999 (KR) ..... 99-42631

(51) Int. Cl.[7] ..... F04B 49/10
(52) U.S. Cl. ..... 417/32
(58) Field of Search ..... 417/32

(56) References Cited

U.S. PATENT DOCUMENTS 5,118,260 A * 6/1992 Fraser, Jr. ..... 417/18
5,200,872 A * 4/1993 D'Entremont et al. ..... 361/25
5,452,989 A * 9/1995 Rood et al. ..... 417/29
6,152,700 A * 11/2000 Ginies ..... 417/32
6,171,064 B1 * 1/2001 Hugenroth et al. ..... 417/32

* cited by examiner

*Primary Examiner*—Charles G. Freay
*Assistant Examiner*—William Rodriguez
(74) *Attorney, Agent, or Firm*—Fleshner & Kim, LLP

(57) ABSTRACT

The present invention relates to an overheat protection device for a scroll compressor which can prevent a sealing member from being damaged due to the overheat, by detecting a temperature of an inhaled or discharged gas of the compressor and directly stopping driving of the compressor, without using a special controller, when the gas temperature exceeds an adequate temperature. In the scroll compressor having in a casing an orbiting scroll and a fixed scroll for inhaling, compressing and discharging a gas, and a driving motor for driving the orbiting scroll, an overheat protection device for the scroll compressor stopping the driving motor when a detected temperature exceeds an adequate temperature, a temperature detection device for detecting a temperature of the gas of a low pressure region where the gas is inhaled and a high pressure region where the gas is discharged through a discharge port of the fixed scroll being connected between a power terminal and the driving motor in an electrical serial state.

10 Claims, 5 Drawing Sheets

OVERHEAT PROTECTION DEVICE FOR SCROLL COMPRESSOR

BACKGROUND OF THE INVENTION

1. Field of the Invention

The present invention relates to an overheat protection device for a scroll compressor, and in particular to an improved overheat protection device for a scroll compressor which can prevent a sealing member from being damaged due to the overheat, by detecting a gas temperature in the compressor and directly stopping driving of the compressor, without using a special controller, when the gas temperature exceeds an adequate temperature.

2. Description of the Background Art

In general, compressors are divided into reciprocating compressors, scroll compressors, centrifugal compressors (generally, 'turbo-compressors') and sliding vane compressors (generally, 'rotary compressors').

Here, the scroll compressor inhales, compresses and discharges a gas by using a rotary body, similarly to the centrifugal compressor or the sliding vane compressor.

The scroll compressors are divided into low pressure scroll compressors and high pressure scroll compressors according to whether a suction gas or a discharge gas is filled in a casing.

FIG. 1 is a half cross-sectional diagram illustrating a vertical scroll compressor of the conventional low pressure scroll compressors.

As depicted in FIG. 1, in the conventional vertical scroll compressor, an upper frame 2 and a lower frame (not shown) are respectively fixed to the upper and lower sides of a vertical casing 1 in which oil is filled at a predetermined height; and a driving motor 4 consisting of a stator 4A and a rotor 4B is firmly fixed between the upper frame 2 and the lower frame (not shown).

A driving shaft 5 is rotatably inserted into the center of the rotor 4B of the driving motor 4, passing through the upper frame 2.

In addition, a wrap 6*a* is formed in an involute curve at an upper surface of a main frame 2, and an orbiting scroll 6 eccentrically connected to the driving shaft 5 is rotatably positioned. A fixed scroll 7 having a wrap 7*a* formed in the involute curve in order to compose a plurality of compression chambers by being engaged with the wrap 6*a* of the orbiting scroll 6 is fixedly disposed at the upper frame 2.

Above the fixed scroll 7, a discharge cover 8 dividing the inside of the casing 1 into a high pressure region and a low pressure region is fixed to the inner circumferential surface of the casing 1. A valve assembly 9 consisting of a valve housing 9A and a valve 9B are provided on a gas discharge hole 8*a* of the discharge cover 8 in order to prevent a reverse-flow of the gas.

Also, an overload protector (OLP) 10 for detecting an inside temperature of the casing 1, namely a temperature of the gas inhaled into the casing 1, and for stopping the compressor by intercepting power applied to the driving motor 4 in the case that the gas temperature exceeds an adequate temperature is provided above the stator 4A of the driving motor 4, in a connection state as shown in FIG. 2.

Reference numerals 5*a* and 7*b* denote an oil path and a discharge port, respectively. Reference marks SP and DP denote a suction pipe and a discharge pipe, respectively.

The operation of the conventional scroll compressor will now be explained.

When the power is applied, the rotor 4B rotates with the driving shaft 5 by the power at an inner portion of the stator 4, thereby eccentrically rotating the orbiting scroll 6 correspondingly to an eccentric distance. At the same time, the orbiting scroll 6 performs an orbiting movement correspondingly to an orbiting radius, centering around the shaft, thereby forming the plurality of compression chambers between the fixed scroll 7 and the wraps 6*a*, 7*a*.

The plurality of compression chambers move to the center according to the constant orbiting movement of the orbiting scroll 6, a volume thereof being reduced. Accordingly, an inhaled refrigerant gas is more compressed, and externally outputted through the discharge port 7*b* of the fixed scroll 7.

At this time, the low pressure refrigerant gas is inhaled into the low pressure region of the casing 1 through the suction pipe SP, and inhaled into the compression chamber by the orbiting movement of the orbiting scroll 6. The overload protector 10 is provided at the low pressure region of the casing 1. Therefore, the overload protector 10 detects a temperature of the refrigerant gas filled in the low pressure region, and stops the compressor by intercepting the power applied to the driving motor 4, when the temperature exceeds the optical temperature.

However, in the conventional scroll compressor, the discharge gas discharged through the discharge port 7B is mixed with oil. When the temperature of the discharge gas abnormally rises, the oil is combusted (carbonized), or the gas in the compression chamber is overheated, thereby dissolving a tip seal inserted into the end portions of the wraps 6*a*, 7*a*. As a result, reliability of the compressor is reduced, and a life span of an air conditioner including the compressor is decreased.

In order to overcome such disadvantages, there was suggested a scroll compressor including a discharge gas temperature detection device as shown in FIG. 3.

According to the aforementioned scroll compressor, a thermostat 20 for detecting the temperature of the discharge gas is connected to the controller connected to the overload protector 10 at the high pressure region of the casing 1, and stops the compressor when the temperature of the discharge gas exceeds the adequate temperature.

However, the conventional scroll compressor having the thermostat needs a special controller, and thus cannot be used for a mechanical system, such as a window type air conditioner which does not have the controller.

SUMMARY OF THE INVENTION

Accordingly, it is an object of the present invention to provide an overheat protection device for a scroll compressor which can detect a gas temperature in a casing without employing a special controller, and directly stop driving of the compressor when the temperature exceeds an adequate temperature.

In order to achieve the above-described object of the present invention, in a scroll compressor having in a casing an orbiting scroll and a fixed scroll for inhaling, compressing and discharging a gas, and a driving motor for driving the orbiting scroll, there is provided an overheat protection device for the scroll compressor stopping the driving motor when a detected temperature exceeds an adequate temperature, a temperature detection device for detecting a temperature of the gas of a low pressure region where the gas is inhaled and a high pressure region where the gas is discharged through a discharge port of the fixed scroll being connected between a power terminal and the driving motor in an electrical serial state.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

An overheat protection device for a scroll compressor in accordance with a preferred embodiment of the present invention will now be described with reference to the accompanying drawings.

Figure 1:
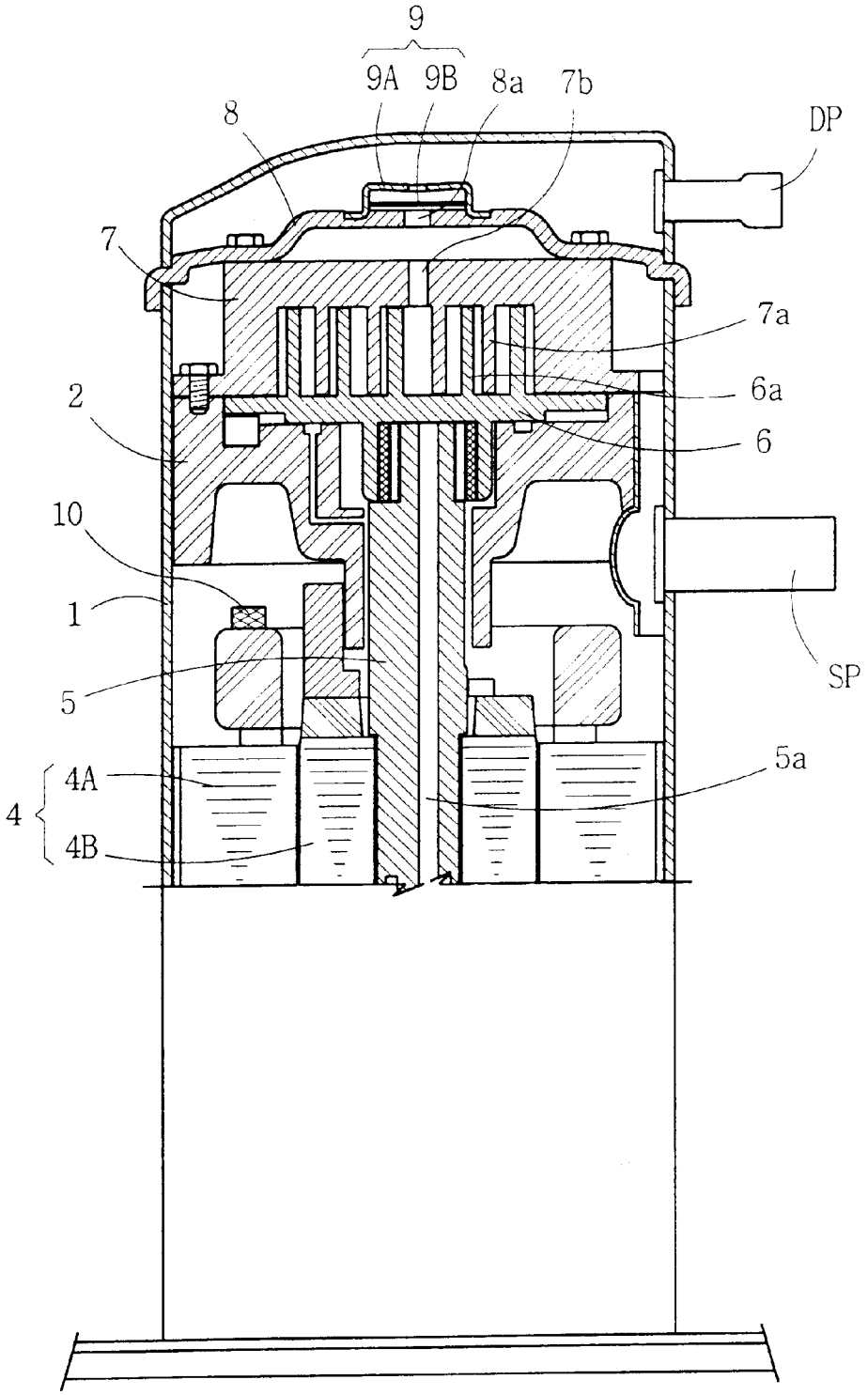
FIG. 1 BACKGROUND ART
FIG. 1 is a vertical-sectional diagram partially illustrating a scroll compressor including an overheat protection device according to one example of the conventional art.
Figure 2:
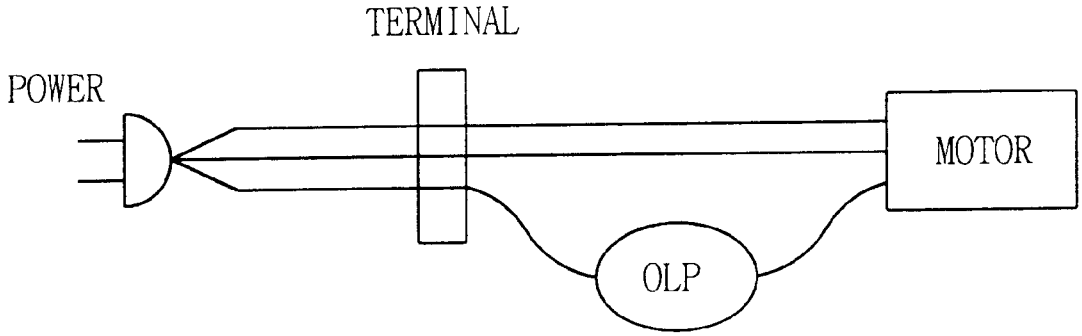
FIG. 2 BACKGROUND ART
FIG. 2 is a schematic diagram illustrating an electric connection state of the overheat protection device according to one example of the conventional art.
Figure 3:
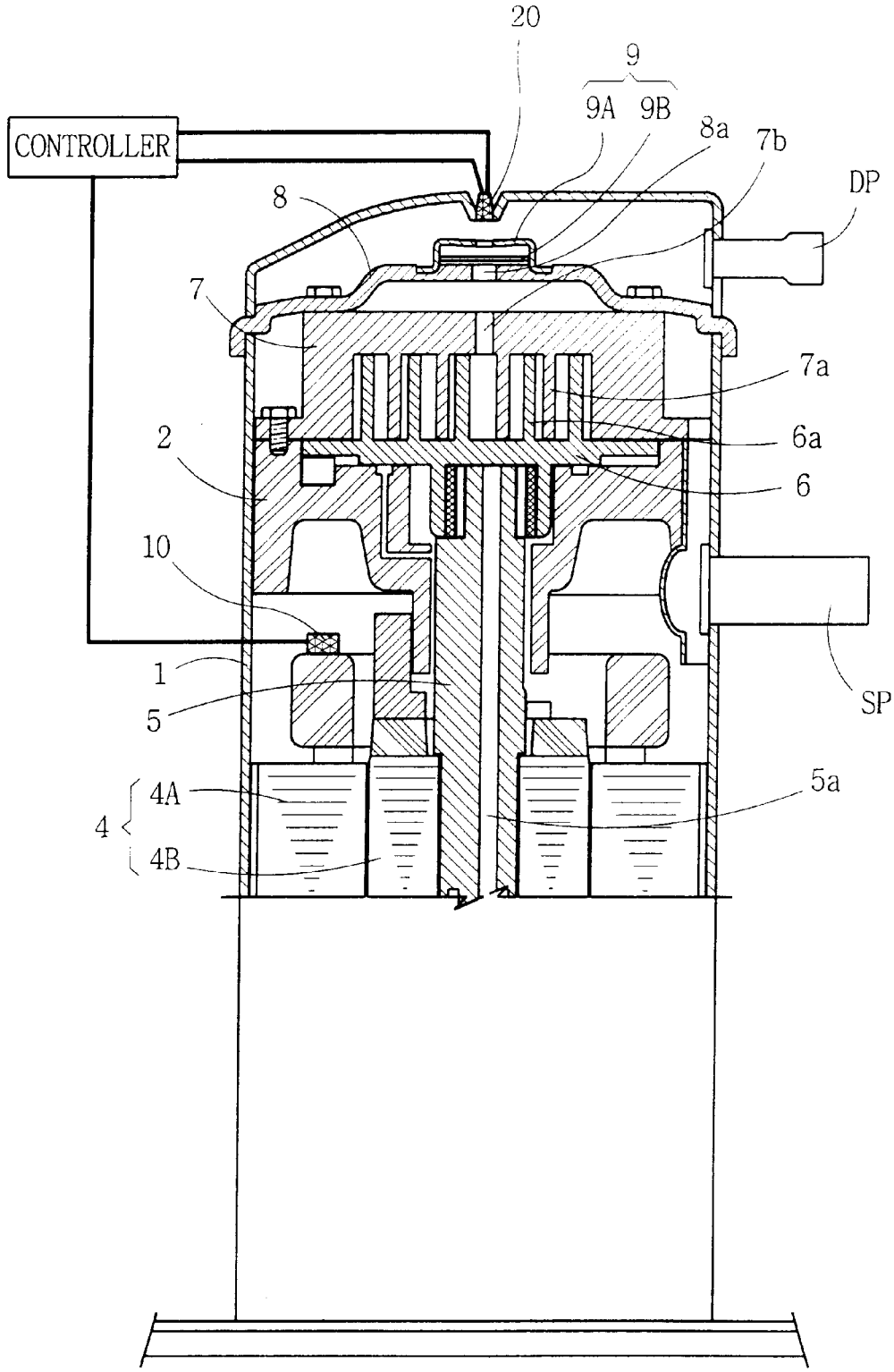
FIG. 3 BACKGROUND ART
FIG. 3 is a vertical-sectional diagram partially illustrating a scroll compressor including an overheat protection device according to another example of the conventional art.
Figure 4:
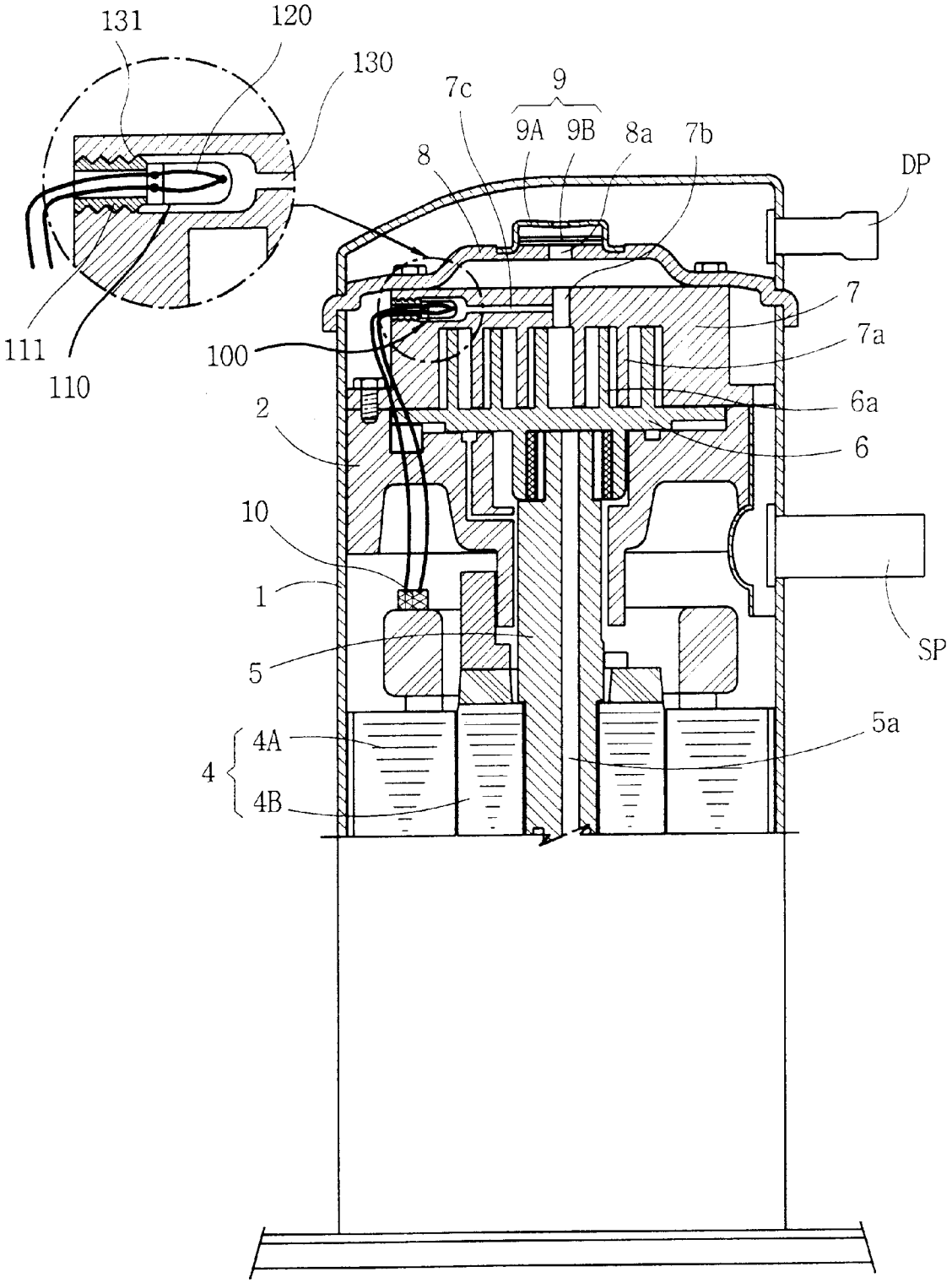
FIG. 4 is a vertical-sectional diagram partially illustrating a scroll compressor including an overheat protection device in accordance with the present invention.
Figure 5:
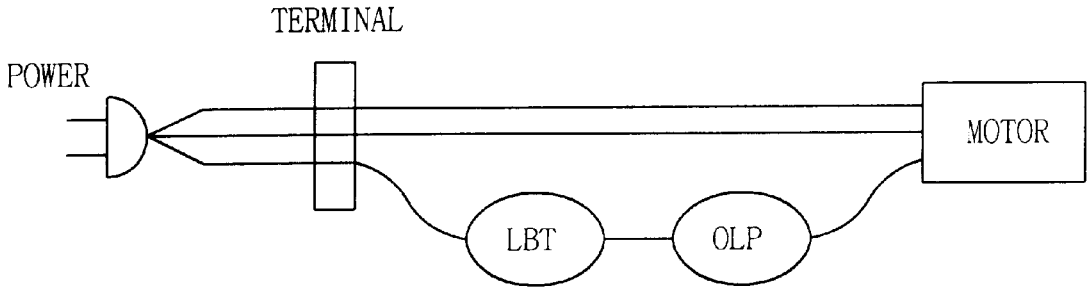
FIG. 5 is a schematic diagram illustrating an electric connection state of the overheat protection device in accordance with the present invention.
Figure 6:
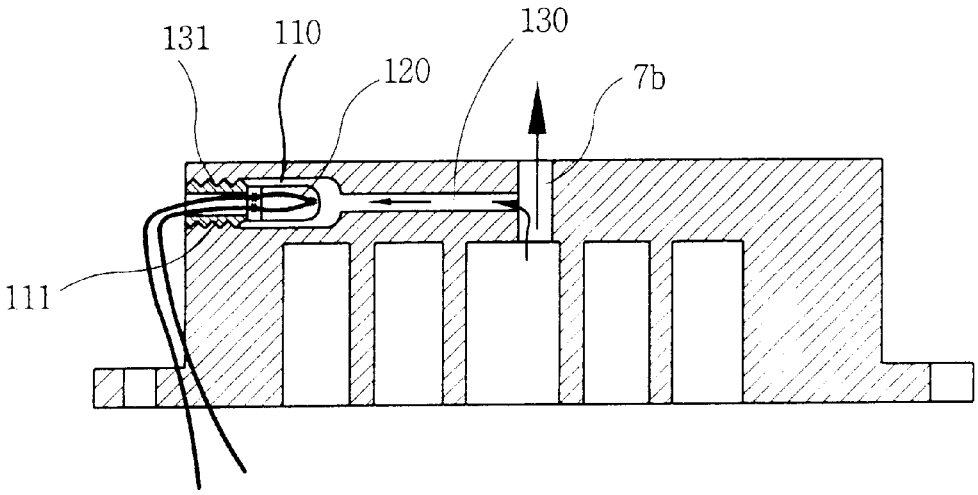
FIG. 6 is a vertical-sectional diagram illustrating a connection state of a line breakable thermostat in the scroll compressor including the overheat protection device in accordance with the present invention.

FIG. 4 is a vertical-sectional diagram partially illustrating the scroll compressor including the overheat protection device in accordance with the present invention, FIG. 5 is a schematic diagram illustrating an electric connection state of the overheat protection device in accordance with the present invention, and FIG. 6 is a vertical-sectional diagram illustrating a connection state of a line breakable thermostat in the scroll compressor including the overheat protection device in accordance with the present invention. The identical components to the conventional art are provided with the same numerals.

As illustrated therein, in the scroll compressor including the overheat protection device in accordance with the present invention, an upper frame 2 and a lower frame (not shown) are fixedly provided at the upper and lower sides of a driving motor 4 in a casing 1, and a driving shaft 5 is inserted into a rotor 4B of the driving motor 4, passing through the upper frame 2.

A wrap 6*a* is formed in an involute curve above the driving motor 4, and a orbiting scroll 6 rotatably positioned at an upper portion of the upper frame 2 is connected thereto. A fixed scroll 7 having a wrap 7*a* formed in the involute curve in order to compose a plurality of compression chambers by being engaged with the wrap 6*a* of the orbiting scroll 6 is fastened to the upper frame 2.

A discharge cover 8 dividing the inside of the casing 1 into a high pressure region and a low pressure region is provided above the fixed scroll 7. A valve assembly 9 consisting of a valve housing 9A and a valve 9B are disposed on a gas discharge hole 8*a* of the discharge cover 8 in order to prevent a reverse-flow of the discharge gas.

A line breakable thermostat (LBT) 100 for detecting a temperature of the discharge gas, and intercepting the power applied to the driving motor 4 when the temperature exceeds an adequate temperature is provided at a middle portion of a discharge hole 7*b* formed at a center of the fixed scroll 7. An overload protector (OLP) 10 for detecting a temperature of a refrigerant gas inhaled into the casing 1, and intercepting the power applied to the driving motor 4 is provided above the stator 4A of the driving motor 4.

The line breakable thermostat 100 is connected between a power terminal and the driving motor 4. A bimetal 120 or bellows for detecting a temperature of the gas discharged to the discharge port 7*b*, and shorting the power is provided in a capsule 110 having a screw unit 111. The screw unit 111 of the capsule 110 is closely fastened to a screw unit 131 of an inner circumference of a vent hole 130 passing through a middle portion of the discharge port 7*b* in a vertical direction.

In addition, the line breakable thermostat 100 is connected in series between the overload protector 10 and the power terminal. Accordingly, when the temperature of the high pressure region or low pressure region in the casing 1 exceeds the adequate temperature, the driving motor 4 is stopped.

Reference numeral 5*a* is an oil path, and reference marks SP and DP are a suction pipe and a discharge pipe, respectively.

The operation of the scroll compressor including the overheat protection device in accordance with the present invention will now be explained.

When the power is applied, the rotor 4B rotates with the driving shaft 5 by the power, thereby eccentrically rotating the orbiting scroll 6 correspondingly to an eccentric distance. The orbiting scroll 6 performs an orbiting movement centering around the shaft, positioned as far as an orbiting radius, forms the plurality of compression chambers between the fixed scroll 7 and the two wraps 6*a*, 7*a*, inhales and compresses the refrigerant gas, and discharges it to the discharge port 7*b*.

At this time, the low pressure refrigerant gas is inhaled into the low pressure region of the casing 1 through the suction pipe SP, and inhaled into the compression chamber during the orbiting movement of the orbiting scroll 6. There is provided the overload protector 10 connected to the low pressure region of the casing 1. The overload protector 10 detects the temperature of the refrigerant gas filled in the low pressure region. When the temperature exceeds the adequate temperature, the overload protector 10 stops the compressor by intercepting the power applied to the driving motor 4.

On the other hand, the discharge gas discharged from the compression chamber through the discharge port 7*b* is partially inhaled into the vent hole 7*c*, and connected to the capsule 110. The capsule 110 is heated by the discharge gas, thus transmitting a heat to the bimetal 120 or bellows which is a connection member.

However, in the case that the temperature of the discharge gas is heated over the adequate temperature, the bimetal 120 or bellows is transformed, thereby intercepting the power between the power terminal and the driving motor and stopping the compressor.

Accordingly, the overload protector is disposed at the low pressure region of the compression chamber, and thus prevents the refrigerant gas from being inhaled and compressed in an overheat state. In addition, whether the discharge gas is overheated is determined by detecting the temperature of the discharge gas discharged from the compression chamber, As a result, it is possible to prevent the oil combustion (carbonization) and tip seal dissolution by the overheating of the discharge gas.

As discussed earlier, the overheat protection device for the scroll compressor detects the gas temperature in the casing, and directly drives the compressor without using a special controller, when the temperature exceeds the adequate temperature. Therefore, the present invention prevents the sealing member from being damaged due to overheat of the discharge gas.

As the present invention may be embodied in several forms without departing from the spirit or essential characteristics thereof, it should also be understood that the above-described embodiment is not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In a scroll compressor having in a casing an orbiting scroll and a fixed scroll for inhaling, comprising and discharging a gas, and a driving motor for driving the orbiting scroll, an overheat protection device comprising:

a first temperature detection device for detecting a temperature of a gas in a low pressure region where the gas is inhaled, and for stopping the driving motor when a detected temperature exceeds an adequate temperature; and a second temperature detection device for detecting a temperature of a gas in a high pressure region where the gas is discharged through a discharge port of the fixed scroll, wherein the overheat protection device is connected in electrical series between a power terminal and the driving motor.

2. The overheat protection device according to claim 1, wherein the second temperature detection device is a line breakable thermostat and comprises a connection member in the form of a breakable capsule for detecting a temperature of the discharge gas and shorting the power, the connection member being positioned in and/or adjacent to a vent hole in communication with a discharge port of the fixed scroll.

3. The overheat protection device according to claim 2, wherein the connection member is a bimetal or bellows.

4. The overheat protection device according to claim 1, wherein the first temperature detection device is an overload protector disposed at one side of the driving motor.

5. A scroll compressor, comprising:

a casing, an inside of which is divided into a high pressure region and a low pressure region;

a fixed scroll and an orbiting scroll for compressing a gas inhaled into the low pressure region;

a driving motor disposed at the low pressure region for driving the orbiting scroll; and an overheat protection device electrically connected between a power terminal and the driving motor in the casing, and comprising a temperature detection device for detecting a temperature of a gas discharged through a discharge port formed at a center of the fixed scroll, and for intercepting the power applied to the driving motor when the temperature exceeds an adequate temperature, wherein the temperature detection device is a line breakable thermostat and comprises a connection member in the form of a breakable capsule for detecting a temperature of the discharge gas and shorting the power, the connection member being positioned in and/or adjacent to a vent hole in communication with a discharge port of the fixed scroll.

6. The scroll compressor according to claim 5, wherein the overheat protection device further comprises:

an overload protector for detecting a temperature of a gas inhaled into the casing, and intercepting the power applied to the driving motor when the temperature exceeds an adequate temperature provided at one side of the driving motor, and wherein the overload protector and the line breakable thermostat are connected in electrical series, and stopping the driving motor when the temperature of the high pressure region or low pressure region of the casing exceeds the respective adequate temperature.

7. A scroll compressor, comprising:

a casing;

an orbiting scroll and a fixed scroll disposed within the casing and configured to inhale, compress and discharge a gas;

a driving motor configured to drive the orbiting scroll; and an overheat protection device comprising:

an overload protector configured to detect a temperature of a gas in a low pressure region of the casing where the gas is inhaled and to stop the driving motor when a detected temperature exceeds an adequate temperature; and a thermostat configured to detect a temperature of a gas in a high pressure region where the gas is discharged through a discharge port of the fixed scroll, wherein the overheat protection device is connected in electrical series between a power terminal and the driving motor.

8. The scroll compressor according to claim 7, wherein the thermostat is a line breakable thermostat and comprises a connection member in the form of a breakable capsule configured to detect a temperature of the discharge gas and short the power, the connection member being positioned in and/or adjacent to a vent hole in communication with a discharge port of the fixed scroll.

9. The scroll compressor according to claim 8, wherein the connection member is a bimetal or bellow.

10. The scroll compressor according to claim 7, wherein the overload protection device is disposed at one side of the driving motor.

* * * * *